US006286153B1

(12) United States Patent
Keller

(10) Patent No.: US 6,286,153 B1
(45) Date of Patent: Sep. 11, 2001

(54) STENCH TRAP FOR A URINAL

(76) Inventor: Hans Keller, Langrütistrasse 77, CH-8635 Dürnten (CH)

( * ) Notice: Subject to any disclaimer, the term of this patent is extended or adjusted under 35 U.S.C. 154(b) by 0 days.

(21) Appl. No.: 09/705,677

(22) Filed: Nov. 3, 2000

Related U.S. Application Data

(63) Continuation of application No. PCT/CH98/00565, filed on Dec. 30, 1998.

(30) Foreign Application Priority Data

May 5, 1998 (CH) ..... 1001/98

(51) Int. Cl.[7] ..... A47K 11/12
(52) U.S. Cl. ..... 4/301; 4/144.1; 4/310; 4/679
(58) Field of Search ..... 4/144.1, 301–303, 4/309–311, 462, 679, 681, DIG. 11, 288, 290, 292, 293, 306; 137/247, 247.11, 247.27, 247.31, 247.33, 247.35, 247.39, 247.49, 362

(56) References Cited

U.S. PATENT DOCUMENTS 5,711,037 * 1/1998 Reichardt et al. ..... 4/301

FOREIGN PATENT DOCUMENTS 28 16 597 9/1979 (DE) .
298 03 397 U1 6/1998 (DE) .
2 164965 4/1986 (GB) .

* cited by examiner

*Primary Examiner*—Gregory L. Huson
*Assistant Examiner*—Tuan Nguyen
(74) *Attorney, Agent, or Firm*—Akin, Gump, Strauss, Hauer & Feld, L.L.P.

(57) ABSTRACT

A waterless urinal (1) is provided with a pot (17) in which urine (35) accumulates. A float (33) floats on the urine (35) and is pressed upwardly by the buoyancy thereof against an opening (31) in the cover (29) of the pot (17). As soon as a pre-determinable column of urine rises above the float (33), the float (33) is pressed downwardly, and the urine (35) can flow out. In a preferred embodiment, the float (33) can be pulled downwardly by an electromagnet, in order to sporadically empty the urine (35), which has accumulated above the float (33) and the cover (29).

10 Claims, 5 Drawing Sheets

STENCH TRAP FOR A URINAL

CROSS REFERENCE TO RELATED APPLICATION

This application is a continuation of International Application PCT/CH98/00565, filed Dec. 30, 1998, the disclosure of which is incorporated herein by reference.

BACKGROUND OF THE INVENTION

The invention relates to a stench trap for a urinal, having an interchangeable pot for insertion in the urinal and a cover for covering the pot. The cover has an opening for introducing urine into the pot, a baffle projecting into the pot for restraining sewer stench from the outlet connection, and a stench trap floating on the urine intended to accumulate in the pot.

From the prior art urinals are known, which must be flushed with water following each use. Due to the reduction of the amount of flushing water as a consequence of higher water prices and/or smaller amounts of water being available, such urinals require a disproportionate cleansing expenditure. Due to the mixture of urine with water, the formation of urine stones is promoted, and not only parts of the urinal, but also in particular the siphon-bearing discharge pipes leading away from this, are reduced in cross section by formation of urine stones within a few months and must consequently be cleansed. In addition to the high costs for the required flushing water, there arc those for the periodic cleansing/repair of the pipes.

For these reasons, waterless urinals have already been proposed. From German published patent application DE-A1 28 16 597 (Ernst), a pot-shaped insert is known, which is inserted into a recess located at the deepest point of the urinal and is connected with the outlet pipe. In the insert an annular space is formed, in which a cylindrical jacket-shaped tube is inserted from above, which subdivides the annular space into two regions, an inner and an outer, which are connected with each other and form a stench barrier or a siphon. A barrier liquid of lower density than water, for example oil, is present in the outer annular space. The urine entering into the container passes through the barrier liquid due to its higher specific gravity and thus reaches the outlet and from there the sewer system. This device has the disadvantage that the barrier liquid, which can contain additional active disinfecting agents and optionally fragrant substances, is successively flushed away by the strong stream of water passing through the barrier liquid during the periodic cleansing of the urinal with a strong torrent of water and consequently loses its action.

In International Patent Application publication WO 97/15735, an insert for a waterless urinal with a barrier liquid is disclosed which, through the special geometrical construction of the insert container, should prevent the barrier liquid from floating away. Even if the floating away of the barrier liquid is substantially prevented there, it cannot be avoided, however, that its active ingredients, which are necessary to create a flawless protection against stench, are successively degraded, and consequently even with this arrangement, the barrier liquid must frequently be replaced. Also, the substances which are used for the barrier liquid are not completely harmless, and can lead to problems with wastewater processing. Monitoring the momentary condition of the barrier liquid can create additional difficulties, since this is not directly examinable, and in principle, only the nose decides whether enough of it is present, or whether this has already been degraded or indeed flushed away.

SUMMARY OF THE INVENTION

The objective of the present invention is the creation of a stench trap, which manages without barrier liquid. This objective is accomplished by a stench trap of the type described at the outset, wherein the stench trap is constructed as a float designed to seal off the opening in the cover. Advantageous embodiments of the invention are described in the following and in the dependent claims.

The arrangement according to the invention operates completely without barrier liquid and can accordingly, if necessary, be periodically thoroughly cleansed without further ado with a torrent of water. Moreover, a doubled stench trap is present, in which first of all the dammed up liquid, namely the urine, flawlessly blocks the stench from the sewer system and moreover, as a second seal, the linear or strip-shaped contact of the float on the collection surface prevents the exit of odors. A build up of urine stones is completely absent, since the portions of water necessary for their formation are not present. The water optionally used with periodic cleansing is negligible for the formation of urine stones, because this can only react with the urine residue for a short time. The lift of the lifting element is so proportioned, that the amount of urine (liquid column) collecting in the cover suffices to depress or raise the lifting element temporarily to the extent that the urine can flow off downwardly. When using a spherical lifting element, this necessarily always lies on the circular opening. In addition, sealants applied to the opening can be installed to increase tightness. In a special embodiment of the invention, a magnet can be arranged below the first container section, in which the lifting element floats, by which the lifting element can be sporadically pulled down and thus the amount of urine situated above its surface can be completely drained off. In this maimer, at times when the urinal is little used, the dammed up amount of liquid can be sporadically removed. Advantageously, the magnet is activated by a capacitor charged by a light sensitive cell.

In a further embodiment of the invention, the lifting element has a U-shaped cross section and covers the upper end of the outlet connection on the container. With this construction the insertion of an additional baffle holding back the stench is dispensed with.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there arc shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
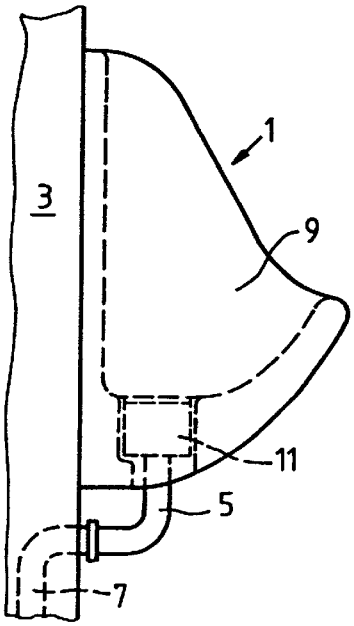
FIG. 1 is a side view of a urinal with a recess for insertion of an exchangeable pot.

In FIG. 1 a urinal is designated schematically with reference numeral 1, which is fastened on a wall 3 and is connected below via an outlet connection 5 to a wastewater conduit 7. The urinal I can be made of ceramics, metal or plastic and has a recess 11 at the deepest point of its collection basin 9, at whose base the outlet connection 5 opens. In the transition between the collection basin 9 and the recess 11, a surrounding ledge 13 is preferably formed, on which lies the flange 15 of a pot-shaped insertion container (pot 17 for short) inserted into the recess 11.

In the first embodiment of the pot 17 forming a stench trap, which includes a jacket 19 and whose bottom is penetrated by the upper part 23 of a discharge tube, a container-shaped space, hereinafter called float space 25, is arranged. At least one part of its jacket can be shared with the jacket 19 of the pot 17. A chord-form running wall 18 separates the float space 25 from an overflow space 27 and the upper part 23 of the outlet connection 5, which is connected with the head space 28 of the overflow space 27. The upper part 23 can be formed by two wall parts 24 or by a pipe (not shown). The upper end 22 of the part 23 lies at a vertical spacing from the ledge 13.

The upper opening of the pot 17 is covered by a frustum-shaped cover 29, at whose deepest point a circular opening 31 is situated. The opening 31 lies over the float space 25. The float space 25 and the at least one overflow space 27 are joined with each other below by a connection opening 37.

Figure 2:
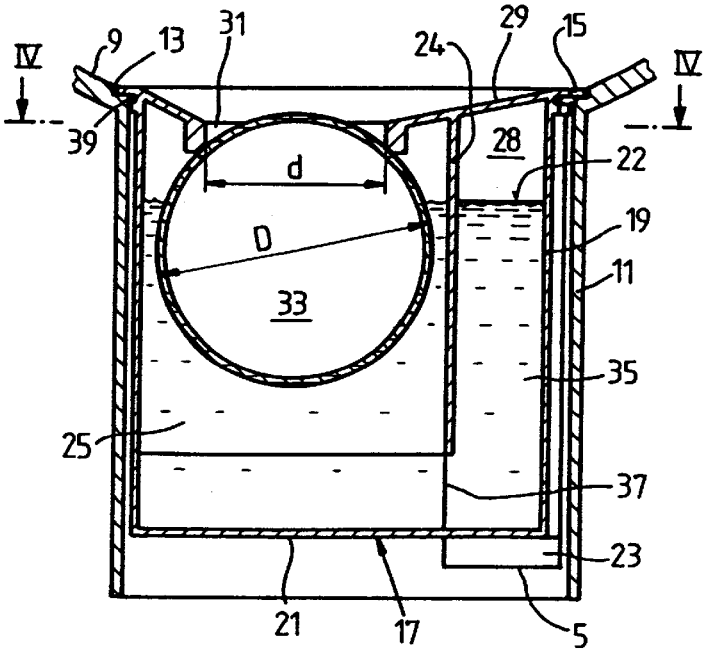
FIG. 2 is a cross section through the urine collection region of the urinal and a pot inserted therein; along line II—II in FIG. 4.

Within the float space 25 lies a freely movable float 33, in the first example according to FIG. 2 a sphere, whose specific density is less than the density of urine 35. The diameter D of the sphere is larger than the diameter d of the opening 31 in the cover 29. Below the flange 15 on the cover 29 an 0-ring or an otherwise constructed seal can be arranged.

Urine 35, flowing from above into the collection basin 9, accumulates on the cover 29. As soon as the liquid column above the opening 31 in the cover 29 exceeds by weight the buoyancy of the float 33 in the float space 25, and consequently is greater than the contact pressure of the float 33 on the cover 29, the float 33 is pressed downwardly and the accumulated urine 35 can flow out downwardly through the opening gap. It then reaches the float space 25, flows from there through the passage opening 37 to the overflow space 27, and thereafter flows into the outlet connection 5. The upper rim of the upper part 23 of the outlet connection 5 lies at a height which assures that the float 33 is pressed against the opening 31, whereby the contact pressure, that is the lift, suffices to guarantee a faultless scale and at the same time also to enable the discharge already of a small amount (i.e., already a liquid column of, e.g., 10 mm) of urine 35 on the cover 29.

Figure 3:
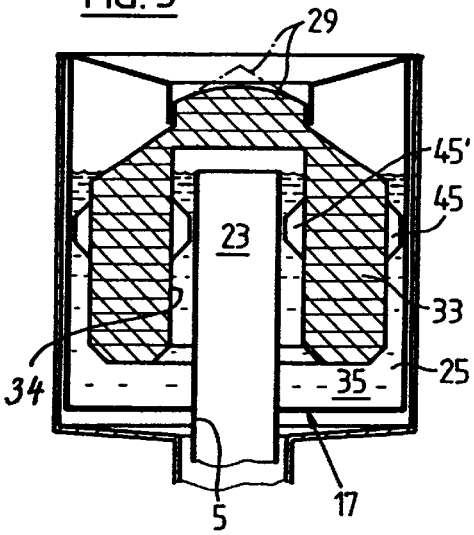
FIG. 3 is a longitudinal section through the container of a further embodiment of a pot; 2
Figure 4:
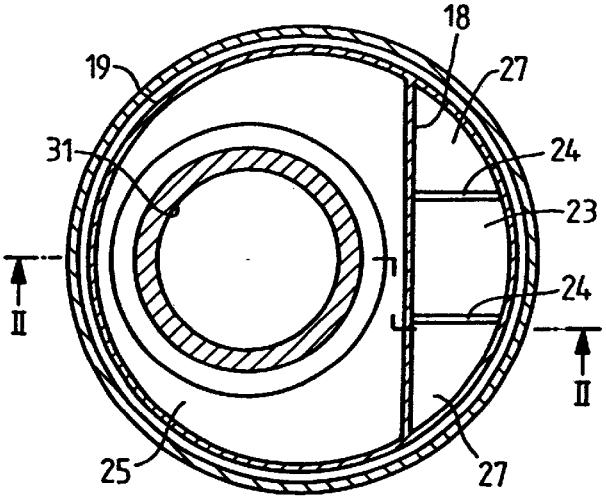
FIG. 4 is a cross section through the pot along line IV—IV in FIG. 2.
Figure 5:
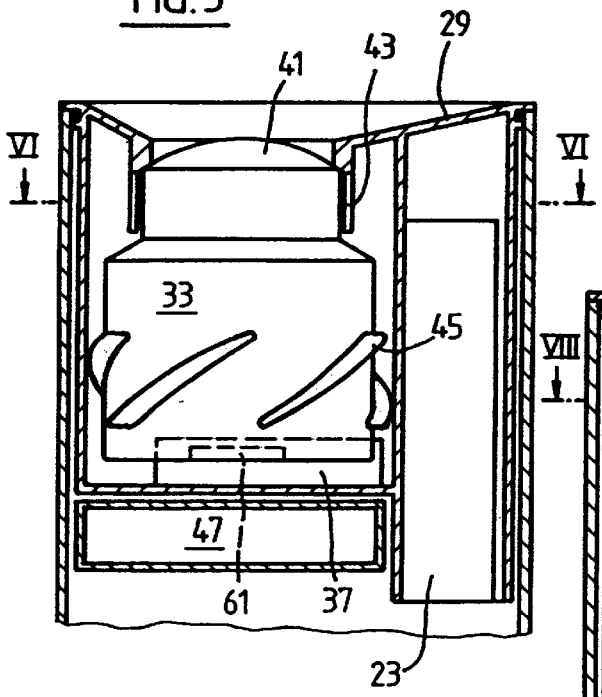
FIG. 5 is a longitudinal section through a further embodiment of a pot along line V—V in FIG. 6 with the float lying on the cover.
Figure 7:
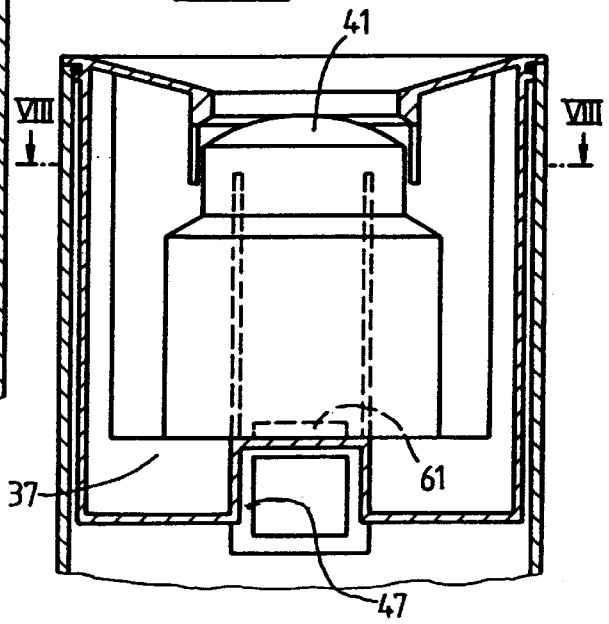
FIG. 7 is a longitudinal section through a further embodiment of a pot along line VII—VII in FIG. 8 with the float depressed.
Figure 6:
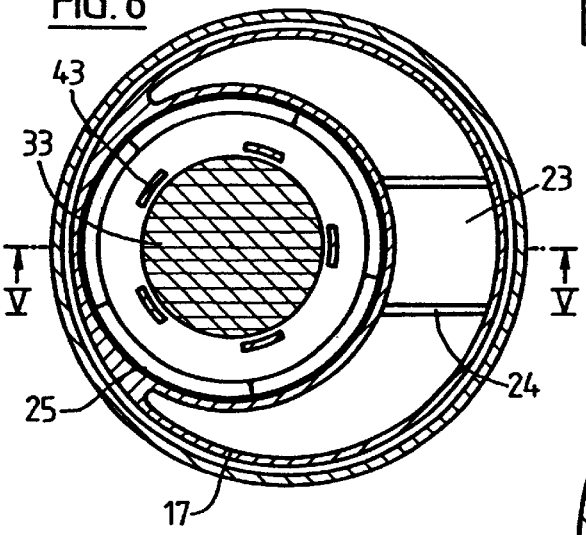
FIG. 6 is a cross section through the pot in FIG. 5 along line VI—VI.
Figure 8:
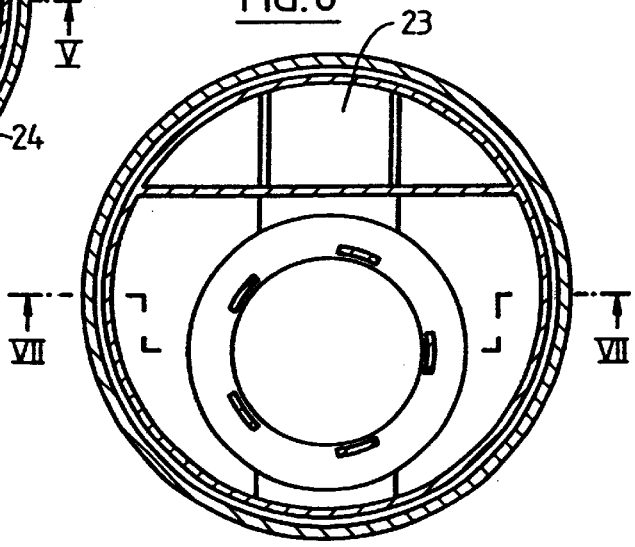
FIG. 8 is a cross section through the pot in FIG. 7 along line VIII—VIII.

In the second embodiment of the invention according to FIG. 3, the outlet nozzle 23 lies in the center of the float space 25, which in this example is identical with the pot 17. The rotation symmetrically-shaped float 33 has a U-shaped cross section and can be manufactured as a hollow body or from a material which has a lesser density than urine. The upper end 23 of the outlet connection 5 comes from below to lie in the cylindrical recess of the float 33. The cylindrical wall 34 of the float 33 surrounding the outlet connection serves as a baffle. The surface of the float 33 lying on top can be shaped as a hemisphere, an ellipse or a cone (indicated in broken lines), so that a flawless linear contact at the opening 31 and optimal sealing can be guaranteed.

In the third embodiment of the invention according to FIGS. 5 to 8, a cylindrical float 33 with a spherical segment or a cone-shaped upper closure 41 replaces a spherical or cap-shaped float 33. Advantageously, the float 33 comprises two cylinders of unequal size, in order to generate as much lift as possible in the lower region. The upper cylindrical region serves at the same time as a vertical guide, laterally guided by the guide segments 43 mounted on the underside of the cover 29. As an alternative to the guide segments 43, ribs 45 can be applied on the jacket of the float 33, which serve as vertical guides. If the latter run helically, represented in FIG. 5, then the float 33 rotates when liquid flows past in larger amounts. The contact and sealing surfaces between the float 33 and the rim of the opening 31 are thereby always kept clean. In cross section according to FIG. 6, it is apparent that the float space 25 is configured as a space arranged eccentrically to the pot 17, likewise constructed cylindrically.

Figure 9:
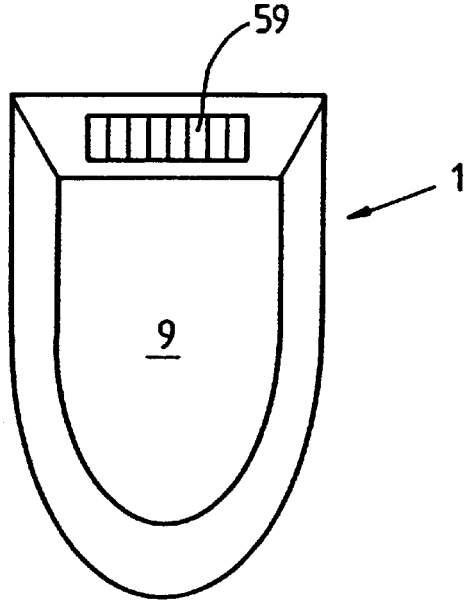
FIG. 9 is a front view of a urinal with solar cells.

In FIGS. 5 through 8 and 10, a laterally open space 47 is represented below the float space 25, in which a depression device for depressing the float 33 can be inserted, in case such is desired. The depression device can include an electromagnet or a permanent magnet 49, wherein the former is activatable by a condenser and/or a battery 55. The battery 55 can be charged by a solar cell 59, which is installed at the top of the urinal 1 (FIGS. 9 and 10) and is illuminated by daylight or artificial light. Alternatively, other energy sources or a manual actuation can also be used for depressing and elevating. The opening of the passage for discharging the urine can take place one or more times while using the urinal.

Figure 10:
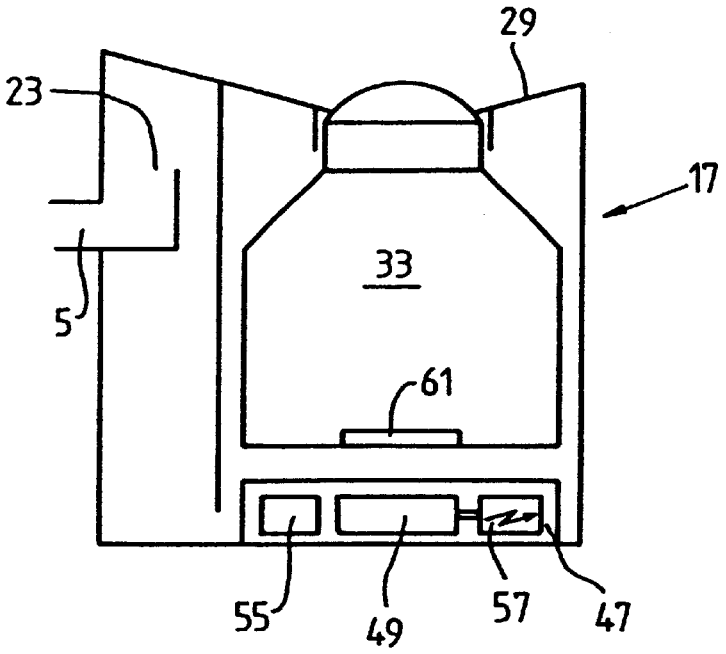
FIG. 10 is a cross section through the pot in a further embodiment of the invention with a slidable magnetic lifting device.

When using a permanent magnet 49 (FIG. 10), the latter is periodically driven back and forth by a linear drive 57 in the area below the float 33. Alternatively, the magnet 49 can also be arranged to be vertically slidable. In order to achieve a certain depression of the float 33, soft iron or a magnetic element 61, e.g., a soft iron plate or a permanent magnet, is inserted on its bottom. Preferably, the element 61 lies outside the float 33 and as near as possible to the magnet 49. When using an electromagnet, this can also be rigidly attached. The float 33 can also be depressable with a manually operable device. In FIG. 10, in addition, an alternative liquid discharge inside the pot 17 is represented. The outlet nozzle 23 extends only over a small height and leaves the pot 17 laterally.

Figure 14:
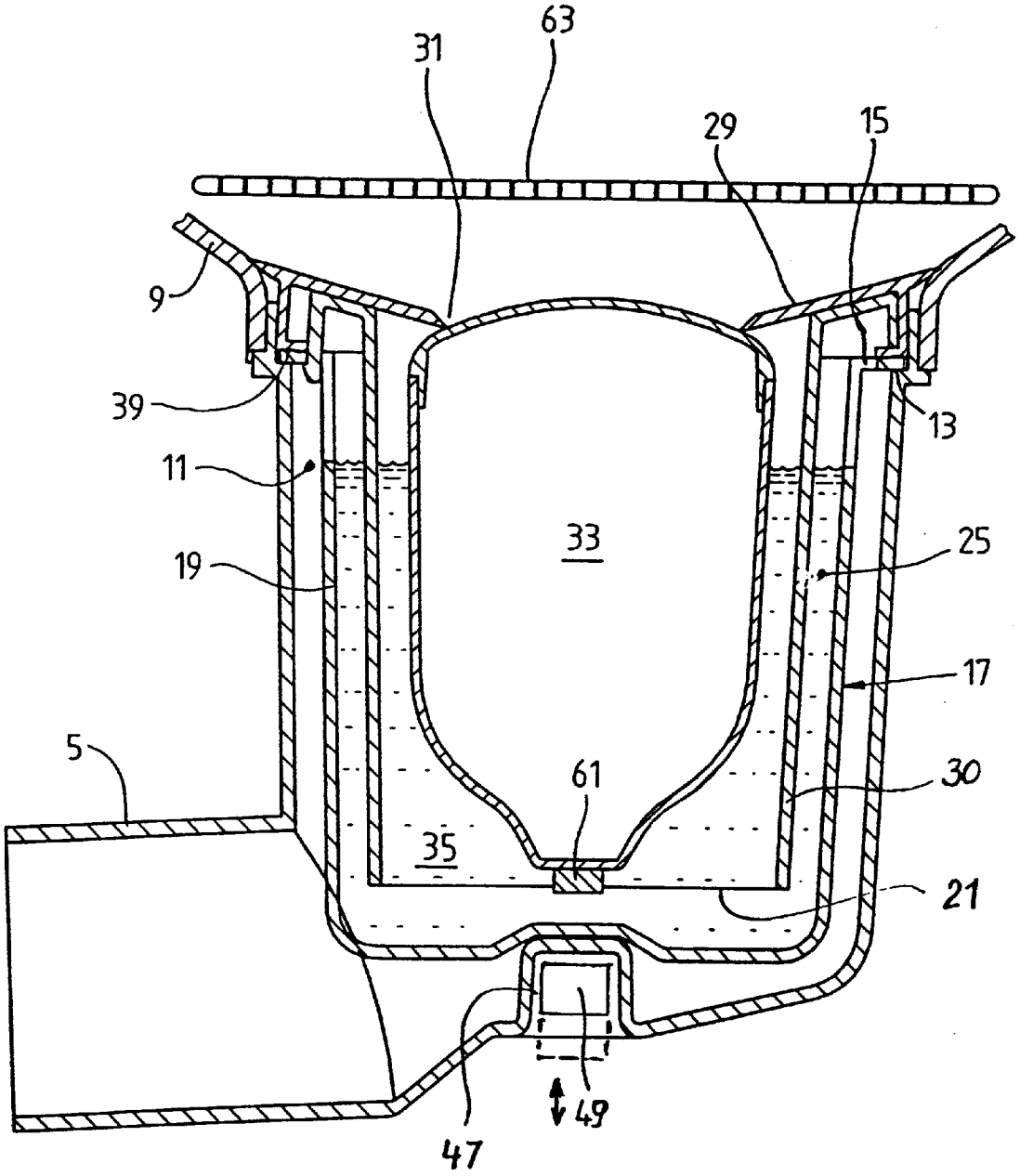
FIG. 14 is a side view of a further embodiment of a stench trap.

In the embodiment of the invention according to FIG. 14, the stench trap is made from elements with exclusively cylindrical jacket-shaped walls. In the likewise cylindrical jacket-shaped recess 11, which can be part of the urinal I or the outlet connection 5, the pot 17 accommodating the stench trap is inserted. This is closed on the bottom and has on its upper edge at least one overflow opening 28, through which the urine 35 from the container space 25 can reach the recess 11 and from there the outlet connection 5. A cylindrical wall part 30 is fastened on the underside of the cover 29, which serves as a baffle and extends into the vicinity of the bottom 21 of the pot 17 and divides the container space 25. The wall palt 30 can be an independent element or form a part of the cover 29. The cover 29 and the pot 17 are preferably firmly connected with one another and are insertable as a unit into the recess 11. The pear-shaped float 33 in this embodiment is loosely secured in the pot. In the space 47 accessible from outside, the depression device, e.g., a permanent or electromagnet 49 (cf. also FIG. 10), can be moved in and out from the side or preferably in a vertical direction from below.

Figure 11:
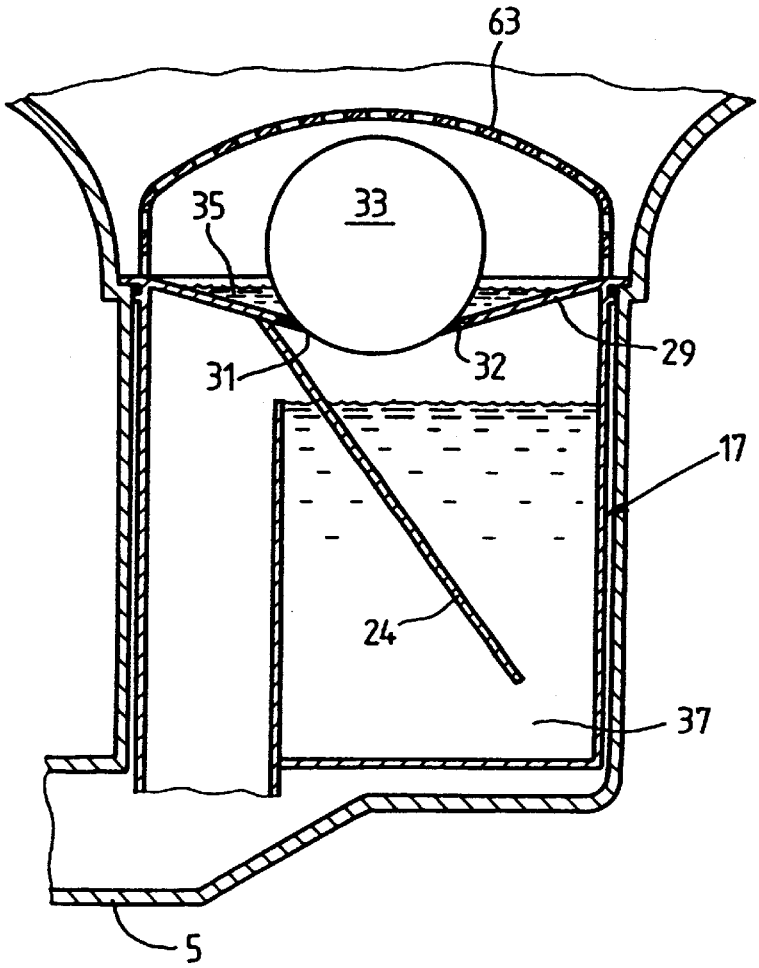
FIG. 11 is a cross section through the pot with a spherical float lying over the cover.

In the further embodiment of the invention according to FIG. 11, the float 33 is spherical and lies on the opening 31 of the cover 29. Along the opening 31 in the cover 29, a seal 32 can be molded on or secured.

Figure 12:
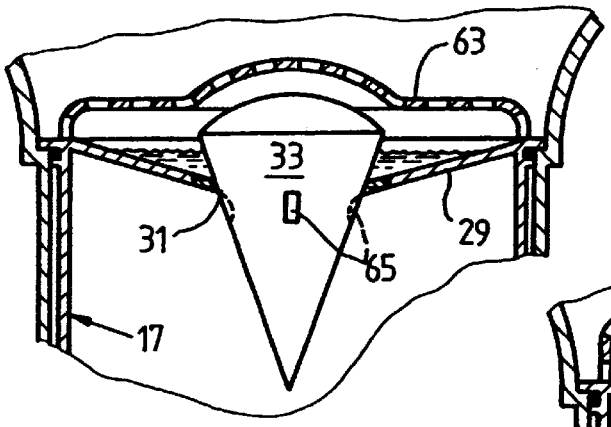
FIG. 12 is a cross section through the cover with a spherical lifting element.

An alternative float 33 is represented in FIG. 12. This has the configuration of a cone, whose tip is guided through opening 31 into the pot 17 and can at least partially dip into the urine 35. In both embodiments (FIGS. 11 and 12) the float 33 is elevated from the urine accumulating above the cover 29, so that the latter can reach the container 25 through the gap thereby arising along the float.

Figure 13:
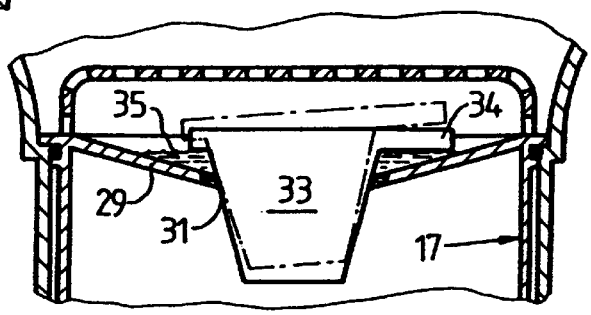
FIG. 13 is a cross section through the cover with an asymmetrical float.

In a further advantageous embodiment of the invention according to FIG. 13, the float 33 is configured frustum-shaped and has on its upper end an asymmetrically arranged plate 34 which, when the urine level rises, causes the float 33 to be elevated on one side, whereby a gap arises not running parallel along opening 31 and thus makes possible a ventilation of the space lying below during the outflow of the urine. On the jacket of the float 33 grooves 65 can be provided in addition, which after the elevation of the float 33 above the opening cross section in the cover 29 project out and facilitate the outflow (illustrated only in FIG. 12).

Preferably, in all embodiments a protective screen or lattice 63 can lie over the cover 29, which bridges over the float 33 and protects the latter from unauthorized access.

The pot 17 can obviously also be inserted in urinals 1, which are not attached to the wall as individual urinals, but rather stand on the floor or are configured as troughs whose deepest point lies in, above or under the level of the floor (not illustrated).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A stench trap for a urinal (1), comprising an interchangeable pot (17) for insertion in the urinal (1), a cover (29) for covering the pot (17), wherein the cover (29) has an opening (31) for introducing urine (35) into the pot (17), a baffle (18, 30, 34) projecting into the pot (17) for restraining sewer stench from an outlet connection (5), and a trap device for floating on the urine (35) intended to accumulate in the pot (17), wherein the trap device is constructed as a float (33) designed to seal off the opening (31) in the cover (29).

2. The stench trap according to claim 1, wherein the float (33) is constructed as a hollow or solid body and is arranged below or above the cover (29).

3. The stench trap according to claim 2, wherein the float (33) lies on the cover (29) and seals off the opening (31) from above, and a lower part of the float (33) projects through the opening (31) into the pot (17).

4. The stench trap according to claim 1, wherein the float (33) is inserted beneath the cover (29) in a float container (25), and a surface of the float (33) designed to protrude above and out of the urine (35) is constructed in a shape of a cone, sphere or spherical segment and is built for contact with a rim of the opening (31) in the cover (29).

5. The stench trap according to claim 4, wherein the float (33) has a spherical or pear-shaped form or a U-shaped cross section.

6. The stench trap according to claim 5, wherein the float (33) is U-shaped in cross section and a cylindrical wall (34) of the U-shaped float (33) surrounds an upper part (23) of the outlet connection (5) and functions as a baffle.

7. The stench trap according to claim 1, wherein the cover (29) is frustum-shaped and the opening (31) is arranged in a frustum-shaped end of the cover (29).

8. A urinal with a stench trap according to claim 1, wherein a magnet or soft iron element (61) is inserted in or mounted on the float (33), and a magnet (49) is arranged beneath a floor of a float container (25), or the float (33) is mechanically depressable.

9. The urinal according to claim 8, wherein the magnet is constructed as an electromagnet (49) and during and after use is electrically activatable one or more times, or the magnet is constructed as an electrically horizontally or vertically slidable permanent magnet (61).

10. The urinal according to claim 9, wherein the electromagnet (49) is charged by a solar cell (59) or another energy source.

* * * * *